US009382853B2

(12) United States Patent
Phillips

(10) Patent No.: US 9,382,853 B2
(45) Date of Patent: Jul. 5, 2016

(54) CYLINDER CONTROL SYSTEMS AND METHODS FOR DISCOURAGING RESONANT FREQUENCY OPERATION

(71) Applicant: GM GLOBAL TECHNOLOGY OPERATIONS LLC, Detroit, MI (US)

(72) Inventor: Andrew W. Phillips, Rochester, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 186 days.

(21) Appl. No.: 13/798,400

(22) Filed: Mar. 13, 2013

(65) Prior Publication Data

US 2014/0207359 A1 Jul. 24, 2014

Related U.S. Application Data

(60) Provisional application No. 61/755,131, filed on Jan. 22, 2013.

(51) Int. Cl.
*F02D 17/02* (2006.01)

(52) U.S. Cl.
CPC ..... *F02D 17/02* (2013.01)

(58) Field of Classification Search
CPC .. F02D 41/0087; F01L 13/0005; F02B 75/06; B60W 10/06; B60T 8/171; G01P 21/00; B60R 21/0132; B60R 21/015; G01M 15/11; G01M 23/225
See application file for complete search history.

(56) References Cited

U.S. PATENT DOCUMENTS 3,596,640 A 8/1971 Bloomfield
4,129,034 A 12/1978 Niles et al.
4,172,434 A 10/1979 Coles
4,377,997 A 3/1983 Staerzl
4,434,767 A 3/1984 Kohama et al.
4,489,695 A 12/1984 Kohama et al.

(Continued)

FOREIGN PATENT DOCUMENTS

CN 1573916 A 2/2005
CN 1888407 A 1/2007

(Continued)

OTHER PUBLICATIONS

U.S. Appl. No. 13/798,451, Rayl, filed Mar. 13, 2013.

(Continued)

*Primary Examiner* — Hung Q Nguyen
*Assistant Examiner* — Brian P Monahon

(57) ABSTRACT

A system includes a command generator module, a compensation module, and a fraction module. The command generator module generates a first command value and one of activates and deactivates intake and exhaust valves of a first cylinder of an engine based on the first command value. The compensation module generates a compensation value for a second cylinder of the engine based on a response of a model to the first command value. The fraction module determines a target value based on a torque request, the target value corresponding to a fraction of a total number of cylinders of the engine to be activated. The command generator module further: generates a second command value based on the compensation value and a difference between the target value and the first command value; and one of activates and deactivates intake and exhaust valves of the second cylinder based on the second command value.

20 Claims, 6 Drawing Sheets

(56) References Cited

U.S. PATENT DOCUMENTS 4,509,488 A 4/1985 Forster et al.
4,535,744 A 8/1985 Matsumura
4,770,148 A 9/1988 Hibino et al.
4,887,216 A 12/1989 Ohnari et al.
4,974,563 A 12/1990 Ikeda et al.
4,987,888 A 1/1991 Funabashi et al.
5,042,444 A 8/1991 Hayes et al.
5,094,213 A 3/1992 Dudek et al.
5,226,513 A 7/1993 Shibayama
5,278,760 A 1/1994 Ribbens et al.
5,357,932 A 10/1994 Clinton et al.
5,374,224 A 12/1994 Huffmaster et al.
5,377,631 A 1/1995 Schechter
5,423,208 A 6/1995 Dudek et al.
5,465,617 A 11/1995 Dudek et al.
5,540,633 A 7/1996 Yamanaka et al.
5,553,575 A 9/1996 Beck et al.
5,584,266 A 12/1996 Motose et al.
5,669,354 A 9/1997 Morris
5,692,471 A 12/1997 Zhang
5,720,257 A 2/1998 Motose et al.
5,813,383 A 9/1998 Cummings
5,884,605 A 3/1999 Nagaishi et al.
5,909,720 A 6/1999 Yamaoka et al.
5,931,140 A 8/1999 Maloney
5,934,263 A 8/1999 Russ et al.
5,975,052 A 11/1999 Moyer
5,983,867 A 11/1999 Stuber et al.
6,125,812 A 10/2000 Garabedian
6,158,411 A 12/2000 Morikawa
6,244,242 B1 6/2001 Grizzle et al.
6,247,449 B1 6/2001 Persson
6,272,427 B1 8/2001 Wild et al.
6,286,366 B1 9/2001 Chen et al.
6,295,500 B1 9/2001 Cullen et al.
6,332,446 B1 12/2001 Matsumoto et al.
6,334,425 B1 1/2002 Nagatani et al.
6,355,986 B1 3/2002 Kato et al.
6,360,724 B1 3/2002 Suhre et al.
6,363,316 B1 3/2002 Soliman et al.
6,371,075 B2 4/2002 Koch
6,385,521 B1 5/2002 Ito
6,520,140 B2 2/2003 Dreymuller et al.
6,546,912 B2 4/2003 Tuken
6,619,258 B2 9/2003 McKay et al.
6,622,548 B1 9/2003 Hernandez
6,694,806 B2 2/2004 Kumagai et al.
6,760,656 B2 7/2004 Matthews et al.
6,978,204 B2 * 12/2005 Surnilla et al. ..... 701/103
6,983,737 B2 1/2006 Gross et al.
7,024,301 B1 4/2006 Kar et al.
7,028,661 B1 4/2006 Bonne et al.
7,032,545 B2 4/2006 Lewis et al.
7,032,581 B2 4/2006 Gibson et al.
7,044,101 B1 5/2006 Duty et al.
7,063,062 B2 6/2006 Lewis et al.
7,066,121 B2 * 6/2006 Michelini et al. ..... 123/90.11
7,069,718 B2 7/2006 Surnilla et al.
7,069,773 B2 7/2006 Stempnik et al.
7,086,386 B2 8/2006 Doering
7,100,720 B2 9/2006 Ishikawa
7,111,612 B2 9/2006 Michelini et al.
7,140,355 B2 11/2006 Michelini et al.
7,174,879 B1 2/2007 Chol et al.
7,200,486 B2 4/2007 Tanaka et al.
7,203,588 B2 4/2007 Kaneko et al.
7,231,907 B2 6/2007 Bolander et al.
7,278,391 B1 10/2007 Wong et al.
7,292,231 B2 11/2007 Kodama et al.
7,292,931 B2 11/2007 Davis et al.
7,319,929 B1 1/2008 Davis et al.
7,363,111 B2 4/2008 Vian et al.
7,440,838 B2 10/2008 Livshiz et al.
7,464,676 B2 12/2008 Wiggins et al.
7,472,014 B1 12/2008 Albertson et al.
7,497,074 B2 3/2009 Surnilla et al.
7,499,791 B2 3/2009 You et al.
7,503,312 B2 3/2009 Surnilla et al.
7,509,201 B2 3/2009 Bolander et al.
7,577,511 B1 8/2009 Tripathi et al.
7,581,531 B2 9/2009 Schulz
7,614,384 B2 11/2009 Livshiz et al.
7,620,188 B2 11/2009 Inoue et al.
7,621,262 B2 11/2009 Zubeck
7,685,976 B2 3/2010 Marriott
7,785,230 B2 8/2010 Gibson et al.
7,836,866 B2 11/2010 Luken et al.
7,849,835 B2 12/2010 Tripathi et al.
7,886,715 B2 2/2011 Tripathi et al.
7,930,087 B2 4/2011 Gibson et al.
7,946,263 B2 5/2011 O'Neill et al.
7,954,474 B2 6/2011 Tripathi et al.
8,050,841 B2 11/2011 Costin et al.
8,099,224 B2 1/2012 Tripathi et al.
8,108,132 B2 1/2012 Reinke
8,131,445 B2 3/2012 Tripathi et al.
8,131,447 B2 3/2012 Tripathi et al.
8,135,410 B2 3/2012 Forte
8,145,410 B2 3/2012 Berger et al.
8,146,565 B2 * 4/2012 Leone et al. ..... 123/319
8,272,367 B2 9/2012 Shikama et al.
8,473,179 B2 6/2013 Whitney et al.
8,616,181 B2 12/2013 Sahandiesfanjani et al.
8,646,430 B2 2/2014 Kinoshita
8,646,435 B2 2/2014 Dibble et al.
8,701,628 B2 4/2014 Tripathi et al.
8,706,383 B2 4/2014 Sauve et al.
8,833,058 B2 9/2014 Ervin et al.
8,833,345 B2 9/2014 Pochner et al.
8,869,773 B2 10/2014 Tripathi et al.
8,979,708 B2 3/2015 Burtch
9,140,622 B2 9/2015 Beikmann
9,222,427 B2 12/2015 Matthews et al.
2001/0007964 A1 7/2001 Poljansek et al.
2002/0156568 A1 10/2002 Knott et al.
2002/0162540 A1 11/2002 Matthews et al.
2002/0189574 A1 12/2002 Kim
2003/0116130 A1 6/2003 Kisaka et al.
2003/0123467 A1 7/2003 Du et al.
2003/0131820 A1 * 7/2003 Mckay et al. ..... 123/198 F
2003/0172900 A1 9/2003 Boyer et al.
2004/0007211 A1 1/2004 Kobayashi
2004/0034460 A1 2/2004 Folkerts et al.
2004/0069290 A1 4/2004 Bucktron et al.
2004/0129249 A1 7/2004 Kondo
2004/0206072 A1 10/2004 Surnilla et al.
2004/0258251 A1 12/2004 Inoue et al.
2005/0016492 A1 1/2005 Matthews
2005/0056250 A1 3/2005 Stroh
2005/0098156 A1 5/2005 Ohtani
2005/0131618 A1 6/2005 Megli et al.
2005/0197761 A1 9/2005 Bidner et al.
2005/0199220 A1 9/2005 Ogiso
2005/0204726 A1 9/2005 Lewis
2005/0204727 A1 9/2005 Lewis et al.
2005/0205028 A1 9/2005 Lewis et al.
2005/0205045 A1 9/2005 Michelini et al.
2005/0205060 A1 9/2005 Michelini et al.
2005/0205063 A1 9/2005 Kolmanovsky et al.
2005/0205069 A1 9/2005 Lewis et al.
2005/0205074 A1 9/2005 Gibson et al.
2005/0235743 A1 10/2005 Stempnik et al.
2006/0107919 A1 * 5/2006 Nishi et al. ..... 123/198 F
2006/0112918 A1 6/2006 Persson
2006/0130814 A1 6/2006 Bolander et al.
2006/0178802 A1 8/2006 Bolander et al.
2007/0012040 A1 1/2007 Nitzke et al.
2007/0042861 A1 2/2007 Takaoka et al.
2007/0100534 A1 5/2007 Katsumata
2007/0101969 A1 5/2007 Lay et al.
2007/0107692 A1 5/2007 Kuo et al.
2007/0131169 A1 6/2007 Ahn
2007/0131196 A1 * 6/2007 Gibson ..... F01L 1/38
123/198 F

(56) References Cited

U.S. PATENT DOCUMENTS

2007/0135988 A1 6/2007 Kidston et al.
2007/0235005 A1 10/2007 Lewis
2008/0000149 A1 1/2008 Aradi
2008/0041327 A1 2/2008 Lewis et al.
2008/0066699 A1 3/2008 Michelini et al.
2008/0121211 A1 5/2008 Livshiz et al.
2008/0154468 A1 6/2008 Berger et al.
2008/0254926 A1 10/2008 Schuseil et al.
2008/0262698 A1 10/2008 Lahti et al.
2008/0288146 A1 11/2008 Beechie et al.
2009/0007877 A1 1/2009 Raiford
2009/0013667 A1 1/2009 Winstead
2009/0013668 A1 1/2009 Winstead
2009/0013669 A1 1/2009 Winstead
2009/0013969 A1 1/2009 Winstead
2009/0030594 A1 1/2009 You et al.
2009/0042458 A1 2/2009 Kinoshita
2009/0118914 A1 5/2009 Schwenke et al.
2009/0118975 A1 5/2009 Murakami et al.
2009/0118986 A1 5/2009 Kita
2009/0177371 A1* 7/2009 Reinke ..... 701/111
2009/0204312 A1 8/2009 Moriya
2009/0241872 A1 10/2009 Wang et al.
2009/0248277 A1 10/2009 Shinagawa et al.
2009/0248278 A1 10/2009 Nakasaka
2009/0292435 A1 11/2009 Costin et al.
2010/0006065 A1 1/2010 Tripathi et al.
2010/0010724 A1 1/2010 Tripathi et al.
2010/0012072 A1 1/2010 Leone et al.
2010/0030447 A1 2/2010 Smyth et al.
2010/0036571 A1 2/2010 Han et al.
2010/0050993 A1 3/2010 Zhao et al.
2010/0059004 A1 3/2010 Gill
2010/0100299 A1* 4/2010 Tripathi et al. ..... 701/102
2010/0107630 A1 5/2010 Hamama et al.
2010/0192925 A1 8/2010 Sadakane
2010/0211299 A1 8/2010 Lewis et al.
2010/0282202 A1 11/2010 Luken
2010/0318275 A1 12/2010 Borchsenius et al.
2011/0030657 A1 2/2011 Tripathi et al.
2011/0048372 A1* 3/2011 Dibble et al. ..... 123/350
2011/0094475 A1 4/2011 Riegel et al.
2011/0107986 A1 5/2011 Winstead
2011/0144883 A1 6/2011 Rollinger et al.
2011/0208405 A1* 8/2011 Tripathi ..... F02D 17/02 701/102
2011/0213540 A1 9/2011 Tripathi et al.
2011/0213541 A1 9/2011 Tripathi et al.
2011/0251773 A1 10/2011 Sahandiesfanjani et al.
2011/0264342 A1 10/2011 Baur et al.
2011/0265454 A1 11/2011 Smith et al.
2011/0265771 A1 11/2011 Banker et al.
2011/0295483 A1 12/2011 Ma et al.
2011/0313643 A1 12/2011 Lucatello et al.
2012/0029787 A1 2/2012 Whitney et al.
2012/0055444 A1 3/2012 Tobergte et al.
2012/0103312 A1 5/2012 Sasai et al.
2012/0109495 A1 5/2012 Tripathi et al.
2012/0116647 A1 5/2012 Pochner et al.
2012/0143471 A1 6/2012 Tripathi et al.
2012/0180759 A1 7/2012 Whitney et al.
2012/0221217 A1 8/2012 Sujan et al.
2012/0285161 A1 11/2012 Kerns et al.
2013/0092127 A1 4/2013 Pirjaberi et al.
2013/0092128 A1 4/2013 Pirjaberi et al.
2013/0184949 A1 7/2013 Saito et al.
2013/0289853 A1 10/2013 Serrano
2014/0041625 A1 2/2014 Pirjaberi et al.
2014/0041641 A1 2/2014 Carlson et al.
2014/0053802 A1 2/2014 Rayl
2014/0053803 A1 2/2014 Rayl
2014/0053804 A1 2/2014 Rayl et al.
2014/0053805 A1 2/2014 Brennan et al.
2014/0069178 A1 3/2014 Beikmann
2014/0069374 A1 3/2014 Matthews
2014/0069375 A1 3/2014 Matthews et al.
2014/0069376 A1 3/2014 Matthews et al.
2014/0069377 A1 3/2014 Brennan et al.
2014/0069378 A1 3/2014 Burleigh et al.
2014/0069379 A1 3/2014 Beikmann
2014/0069381 A1 3/2014 Beikmann
2014/0090623 A1 4/2014 Beikmann
2014/0090624 A1 4/2014 Verner
2014/0102411 A1 4/2014 Brennan
2014/0190448 A1 7/2014 Brennan et al.
2014/0190449 A1 7/2014 Phillips
2014/0194247 A1 7/2014 Burtch
2015/0240671 A1 8/2015 Nakamura
2015/0260112 A1 9/2015 Liu et al.
2015/0260117 A1 9/2015 Shost et al.
2015/0354470 A1 12/2015 Li et al.
2015/0361907 A1 12/2015 Hayman et al.

FOREIGN PATENT DOCUMENTS

CN 101220780 A 7/2008
CN 101353992 A 1/2009
CN 101586504 A 11/2009
CN 102454493 A 5/2012
EP 1489595 A2 12/2004
JP 2011149352 8/2011

OTHER PUBLICATIONS

U.S. Appl. No. 13/798,351, Rayl, filed Mar. 13, 2013.
U.S. Appl. No. 13/798,586, Rayl et al., filed Mar. 13, 2013.
U.S. Appl. No. 13/798,590, Brennan et al., filed Mar. 13, 2013.
U.S. Appl. No. 13/798,536, Matthews et al., filed Mar. 13, 2013.
U.S. Appl. No. 13/798,435, Matthews, filed Mar. 13, 2013.
U.S. Appl. No. 13/798,471, Matthews et al., filed Mar. 13, 2013.
U.S. Appl. No. 13/798,737, Beikmann, filed Mar. 13, 2013.
U.S. Appl. No. 13/798,701, Burleigh et al., filed Mar. 13, 2013.
U.S. Appl. No. 13/798,518, Beikmann, filed Mar. 13, 2013.
U.S. Appl. No. 13/799,129, Beikmann, filed Mar. 13, 2013.
U.S. Appl. No. 13/798,540, Brennan et al., filed Mar. 13, 2013.
U.S. Appl. No. 13/798,574, Verner, filed Mar. 13, 2013.
U.S. Appl. No. 13/799,181, Beikmann, filed Mar. 13, 2013.
U.S. Appl. No. 13/799,116, Brennan, filed Mar. 13, 2013.
U.S. Appl. No. 13/798,624, Brennan et al., filed Mar. 13, 2013.
U.S. Appl. No. 13/798,384, Burtch, filed Mar. 13, 2013.
U.S. Appl. No. 13/798,775, Phillips, filed Mar. 13, 2013.
U.S. Appl. No. 13/798,400, Phillips, filed Mar. 13, 2013.
U.S. Appl. No. 14/211,389, filed Mar. 14, 2014, Liu et al.
U.S. Appl. No. 14/300,469, filed Jun. 10, 2014, Li et al.
U.S. Appl. No. 14/310,063, filed Jun. 20, 2014, Wagh et al.
U.S. Appl. No. 14/449,726, filed Aug. 1, 2014, Hayman et al.
U.S. Appl. No. 14/548,501, filed Mar. 20, 2014, Beikmann et al.
U.S. Appl. No. 61/952,737, filed Mar. 13, 2014, Shost et al.
International Search Report and Written Opinion dated Jun. 17, 2015 corresponding to International Application No. PCT/US2015/019496, 14 pages.
U.S. Appl. No. 14/734,619, filed Jun. 9, 2015, Matthews.

* cited by examiner

CYLINDER CONTROL SYSTEMS AND METHODS FOR DISCOURAGING RESONANT FREQUENCY OPERATION

CROSS-REFERENCE TO RELATED APPLICATIONS

This application claims the benefit of U.S. Provisional Application No. 61/755,131, filed on Jan. 22, 2013. The disclosure of the above application is incorporated herein by reference in its entirety.

This application is related to U.S. patent application Ser. No. 13/798,451 filed on Mar. 13, 2013, Ser. No. 13/798,351 filed on Mar. 13, 2013, Ser. No. 13/798,586 filed on Mar. 13, 2013, Ser. No. 13/798,590 filed on Mar. 13, 2013, Ser. No. 13/798,536 filed on Mar. 13, 2013, Ser. No. 13/798,435 filed on Mar. 13, 2013, Ser. No. 13/798,471 filed on Mar. 13, 2013, Ser. No. 13/798,737 filed on Mar. 13, 2013, Ser. No. 13/798,701 filed on Mar. 13, 2013, Ser. No. 13/798,518 filed on Mar. 13, 2013, Ser. No. 13/799,129 filed on Mar. 13, 2013, Ser. No. 13/798,540 filed on Mar. 13, 2013, Ser. No. 13/798,574 filed on Mar. 13, 2013, Ser. No. 13/799,181 filed on Mar. 13, 2013, Ser. No. 13/799,116 filed on Mar. 13, 2013, Ser. No. 13/798,624 filed on Mar. 13, 2013, Ser. No. 13/798,384 filed on Mar. 13, 2013, and Ser. No. 13/798,775 filed on Mar. 13, 2013. The entire disclosures of the above applications are incorporated herein by reference.

FIELD

The present disclosure relates to internal combustion engines and more specifically to engine control systems and methods.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air and fuel mixture within cylinders to drive pistons, which produces drive torque. In some types of engines, air flow into the engine may be regulated via a throttle. The throttle may adjust throttle area, which increases or decreases air flow into the engine. As the throttle area increases, the air flow into the engine increases. A fuel control system adjusts the rate that fuel is injected to provide a desired air/fuel mixture to the cylinders and/or to achieve a desired torque output. Increasing the amount of air and fuel provided to the cylinders increases the torque output of the engine.

Under some circumstances, one or more cylinders of an engine may be deactivated. Deactivation of a cylinder may include deactivating opening and closing of intake valves of the cylinder and halting fueling of the cylinder. One or more cylinders may be deactivated, for example, to decrease fuel consumption when the engine can produce a requested amount of torque while the one or more cylinders are deactivated.

SUMMARY

A cylinder control system includes a command generator module, a compensation module, and a fraction module. The command generator module generates a first command value and one of activates and deactivates intake and exhaust valves of a first cylinder of an engine based on the first command value. The compensation module generates a compensation value for a second cylinder of the engine based on a response of a model to the first command value. The fraction module determines a target value based on a torque request, the target value corresponding to a fraction of a total number of cylinders of the engine to be activated. The command generator module further: generates a second command value based on the compensation value and a difference between the target value and the first command value; and one of activates and deactivates intake and exhaust valves of the second cylinder based on the second command value.

A cylinder control method includes: generating a first command value; one of activating and deactivating intake and exhaust valves of a first cylinder of an engine based on the first command value; and generating a compensation value for a second cylinder of the engine based on a response of a model to the first command value. The cylinder control method further includes: determining a target value based on a torque request, the target value corresponding to a fraction of a total number of cylinders of the engine to be activated; generating a second command value based on the compensation value and a difference between the target value and the first command value; and one of activating and deactivating intake and exhaust valves of the second cylinder based on the second command value.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Internal combustion engines combust an air and fuel mixture within cylinders to generate torque. Under some circumstances, an engine control module (ECM) may deactivate one or more cylinders of the engine. The ECM may deactivate one or more cylinders, for example, to decrease fuel consumption when the engine can produce a requested amount of torque while one or more cylinders are deactivated.

The ECM determines a target firing fraction based on a requested amount of torque. The target firing fraction may correspond to a fraction of the cylinders that should be activated to achieve the requested amount of torque. The ECM generates a firing command for a future (e.g., next) cylinder in a predetermined firing order of the cylinders based on the target firing fraction. The firing command may be a value that indicates whether the future cylinder should be activated or deactivated. For example, the ECM may set the firing command to 1 when the future cylinder should be activated and set the firing command to 0 when the future cylinder should be deactivated.

The ECM generates the firing command further based on firing commands generated for cylinders before the cylinder in the firing order. More specifically, the ECM determines a difference between the target firing fraction and the value of a previous firing command generated for a previous (e.g., last) cylinder in the predetermined firing order. The ECM sums values of the difference determined over time to generate an accumulated difference and generates the firing command for the future cylinder based on the accumulated difference.

Under some circumstances, however, the frequency at which the cylinders are activated may approach or become equal to a predetermined resonant frequency of the vehicle. A magnitude of noise and/or vibration may increase as the frequency at which the cylinders are activated approaches the predetermined resonant frequency.

The ECM of the present disclosure determines a compensation value for the future cylinder based on a response of a virtual (plant) model to the previous firing command generated for the previous cylinder. The virtual model is configured based on a predetermined resonant frequency of the vehicle. The ECM adjusts the accumulated difference based on the compensation value and generates the firing command for the future cylinder based on the adjusted value of the accumulated difference. Adjusting the accumulated difference based on the compensation value discourages firing of the future cylinder when firing of the future cylinder would increase resonant energy (and increase noise and/or vibration) and encourages firing of the future cylinder when firing of the future cylinder would decrease resonant energy (and decrease noise and/or vibration).

Figure 1:
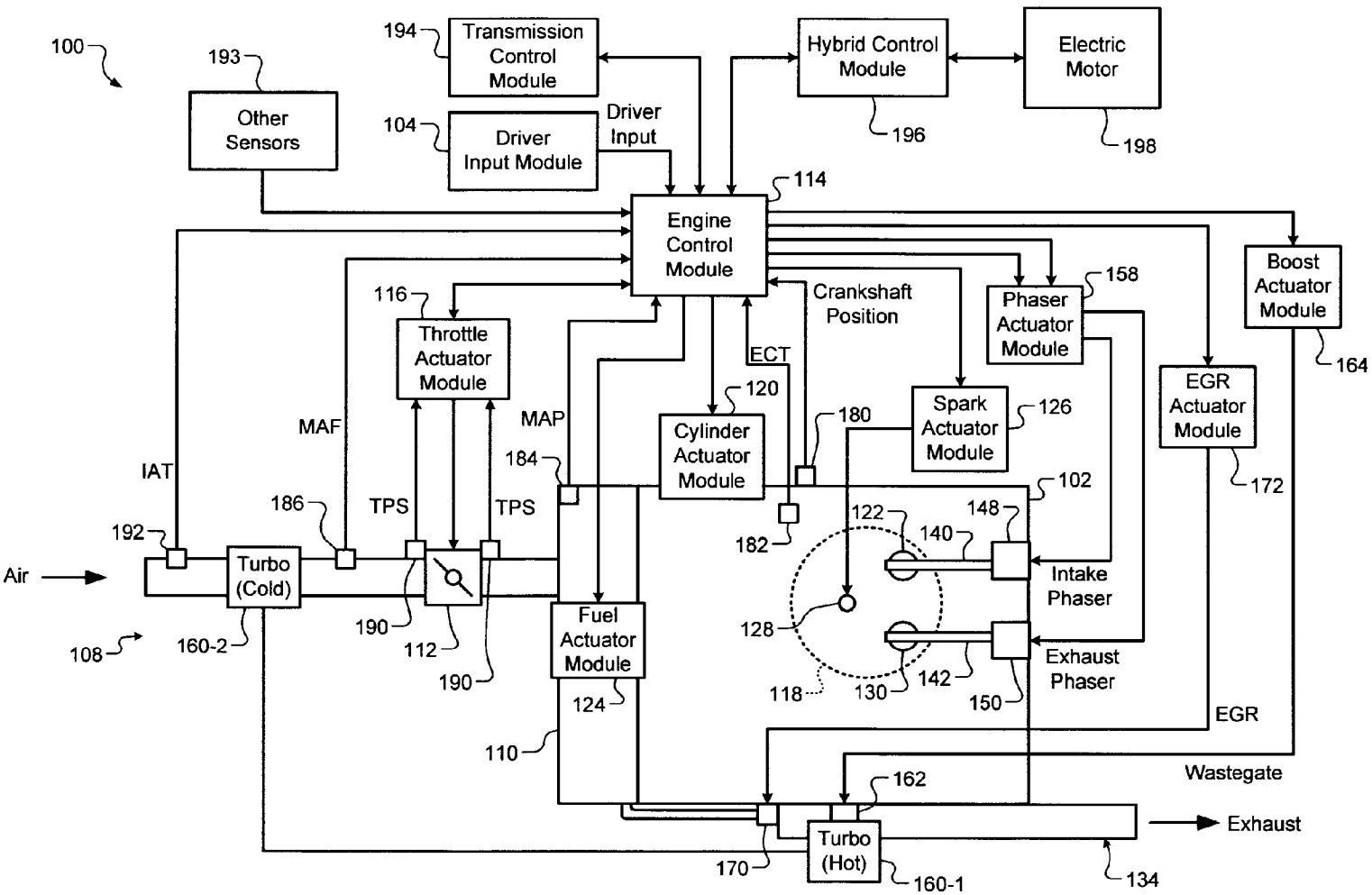
FIG. 1 is a functional block diagram of an example engine system according to the present disclosure.

Referring now to FIG. 1, a functional block diagram of an example engine system 100 is presented. The engine system 100 of a vehicle includes an engine 102 that combusts an air/fuel mixture to produce torque based on driver input from a driver input module 104. Air is drawn into the engine 102 through an intake system 108. The intake system 108 may include an intake manifold 110 and a throttle valve 112. For example only, the throttle valve 112 may include a butterfly valve having a rotatable blade. An engine control module (ECM) 114 controls a throttle actuator module 116, and the throttle actuator module 116 regulates opening of the throttle valve 112 to control airflow into the intake manifold 110.

Air from the intake manifold 110 is drawn into cylinders of the engine 102. While the engine 102 includes multiple cylinders, for illustration purposes a single representative cylinder 118 is shown. For example only, the engine 102 may include 2, 3, 4, 5, 6, 8, 10, and/or 12 cylinders. The ECM 114 may instruct a cylinder actuator module 120 to selectively deactivate some of the cylinders under some circumstances, as discussed further below, which may improve fuel efficiency.

The engine 102 may operate using a four-stroke cycle. The four strokes, described below, will be referred to as the intake stroke, the compression stroke, the combustion stroke, and the exhaust stroke. During each revolution of a crankshaft (not shown), two of the four strokes occur within the cylinder 118. Therefore, two crankshaft revolutions are necessary for the cylinder 118 to experience all four of the strokes. For four-stroke engines, one engine cycle may correspond to two crankshaft revolutions.

When the cylinder 118 is activated, air from the intake manifold 110 is drawn into the cylinder 118 through an intake valve 122 during the intake stroke. The ECM 114 controls a fuel actuator module 124, which regulates fuel injection to achieve a desired air/fuel ratio. Fuel may be injected into the intake manifold 110 at a central location or at multiple locations, such as near the intake valve 122 of each of the cylinders. In various implementations (not shown), fuel may be injected directly into the cylinders or into mixing chambers/ports associated with the cylinders. The fuel actuator module 124 may halt injection of fuel to cylinders that are deactivated.

The injected fuel mixes with air and creates an air/fuel mixture in the cylinder 118. During the compression stroke, a piston (not shown) within the cylinder 118 compresses the air/fuel mixture. The engine 102 may be a compression-ignition engine, in which case compression causes ignition of the air/fuel mixture. Alternatively, the engine 102 may be a spark-ignition engine, in which case a spark actuator module 126 energizes a spark plug 128 in the cylinder 118 based on a signal from the ECM 114, which ignites the air/fuel mixture. Some types of engines, such as homogenous charge compression ignition (HCCI) engines may perform both compression ignition and spark ignition. The timing of the spark may be specified relative to the time when the piston is at its topmost position, which will be referred to as top dead center (TDC).

The spark actuator module 126 may be controlled by a timing signal specifying how far before or after TDC to generate the spark. Because piston position is directly related to crankshaft rotation, operation of the spark actuator module 126 may be synchronized with the position of the crankshaft. The spark actuator module 126 may halt provision of spark to deactivated cylinders or provide spark to deactivated cylinders.

During the combustion stroke, the combustion of the air/fuel mixture drives the piston down, thereby driving the crankshaft. The combustion stroke may be defined as the time between the piston reaching TDC and the time at which the piston returns to a bottom most position, which will be referred to as bottom dead center (BDC).

During the exhaust stroke, the piston begins moving up from BDC and expels the byproducts of combustion through an exhaust valve 130. The byproducts of combustion are exhausted from the vehicle via an exhaust system 134.

The intake valve 122 may be controlled by an intake camshaft 140, while the exhaust valve 130 may be controlled by an exhaust camshaft 142. In various implementations, multiple intake camshafts (including the intake camshaft 140) may control multiple intake valves (including the intake valve 122) for the cylinder 118 and/or may control the intake valves (including the intake valve 122) of multiple banks of cylinders (including the cylinder 118). Similarly, multiple exhaust camshafts (including the exhaust camshaft 142) may control multiple exhaust valves for the cylinder 118 and/or may control exhaust valves (including the exhaust valve 130) for multiple banks of cylinders (including the cylinder 118). While camshaft based valve actuation is shown and has been discussed, camless valve actuators may be implemented.

The cylinder actuator module 120 may deactivate the cylinder 118 by disabling opening of the intake valve 122 and/or the exhaust valve 130. The time at which the intake valve 122 is opened may be varied with respect to piston TDC by an intake cam phaser 148. The time at which the exhaust valve 130 is opened may be varied with respect to piston TDC by an exhaust cam phaser 150. A phaser actuator module 158 may control the intake cam phaser 148 and the exhaust cam phaser 150 based on signals from the ECM 114. When implemented, variable valve lift (not shown) may also be controlled by the phaser actuator module 158. In various other implementations, the intake valve 122 and/or the exhaust valve 130 may be controlled by actuators other than a camshaft, such as electromechanical actuators, electrohydraulic actuators, electromagnetic actuators, etc.

The engine system 100 may include a boost device that provides pressurized air to the intake manifold 110. For example, FIG. 1 shows a turbocharger including a turbine 160-1 that is driven by exhaust gases flowing through the exhaust system 134. The turbocharger also includes a compressor 160-2 that is driven by the turbine 160-1 and that compresses air leading into the throttle valve 112. In various implementations, a supercharger (not shown), driven by the crankshaft, may compress air from the throttle valve 112 and deliver the compressed air to the intake manifold 110.

A wastegate 162 may allow exhaust to bypass the turbine 160-1, thereby reducing the boost (the amount of intake air compression) of the turbocharger. The ECM 114 may control the turbocharger via a boost actuator module 164. The boost actuator module 164 may modulate the boost of the turbocharger by controlling the position of the wastegate 162. In various implementations, multiple turbochargers may be controlled by the boost actuator module 164. The turbocharger may have variable geometry, which may be controlled by the boost actuator module 164.

An intercooler (not shown) may dissipate some of the heat contained in the compressed air charge, which is generated as the air is compressed. Although shown separated for purposes of illustration, the turbine 160-1 and the compressor 160-2 may be mechanically linked to each other, placing intake air in close proximity to hot exhaust. The compressed air charge may absorb heat from components of the exhaust system 134.

The engine system 100 may include an exhaust gas recirculation (EGR) valve 170, which selectively redirects exhaust gas back to the intake manifold 110. The EGR valve 170 may be located upstream of the turbocharger's turbine 160-1. The EGR valve 170 may be controlled by an EGR actuator module 172.

Crankshaft position may be measured using a crankshaft position sensor 180. A temperature of engine coolant may be measured using an engine coolant temperature (ECT) sensor 182. The ECT sensor 182 may be located within the engine 102 or at other locations where the coolant is circulated, such as a radiator (not shown).

A pressure within the intake manifold 110 may be measured using a manifold absolute pressure (MAP) sensor 184. In various implementations, engine vacuum, which is the difference between ambient air pressure and the pressure within the intake manifold 110, may be measured. A mass flow rate of air flowing into the intake manifold 110 may be measured using a mass air flow (MAF) sensor 186. In various implementations, the MAF sensor 186 may be located in a housing that also includes the throttle valve 112.

Position of the throttle valve 112 may be measured using one or more throttle position sensors (TPS) 190. A temperature of air being drawn into the engine 102 may be measured using an intake air temperature (IAT) sensor 192. The engine system 100 may also include one or more other sensors 193. The ECM 114 may use signals from the sensors to make control decisions for the engine system 100.

The ECM 114 may communicate with a transmission control module 194 to coordinate shifting gears in a transmission (not shown). For example, the ECM 114 may reduce engine torque during a gear shift. The engine 102 outputs torque to a transmission (not shown) via the crankshaft. One or more coupling devices, such as a torque converter and/or one or more clutches, regulate torque transfer between a transmission input shaft and the crankshaft. Torque is transferred between the transmission input shaft and a transmission output shaft via the gears.

Torque is transferred between the transmission output shaft and wheels of the vehicle via one or more differentials, driveshafts, etc. The engine 102, the transmission, the differential (s), driveshafts, and other torque transferring or creating components make up a powertrain of the vehicle.

The ECM 114 may communicate with a hybrid control module 196 to coordinate operation of the engine 102 and an electric motor 198. The electric motor 198 may also function as a generator, and may be used to produce electrical energy for use by vehicle electrical systems and/or for storage in a battery. While only the electric motor 198 is shown and discussed, multiple electric motors may be implemented. In various implementations, various functions of the ECM 114, the transmission control module 194, and the hybrid control module 196 may be integrated into one or more modules.

Each system that varies an engine parameter may be referred to as an engine actuator. Each engine actuator has an associated actuator value. For example, the throttle actuator module 116 may be referred to as an engine actuator, and the throttle opening area may be referred to as the actuator value. In the example of FIG. 1, the throttle actuator module 116 achieves the throttle opening area by adjusting an angle of the blade of the throttle valve 112.

The spark actuator module 126 may also be referred to as an engine actuator, while the corresponding actuator value may be the amount of spark advance relative to cylinder TDC. Other engine actuators may include the cylinder actuator module 120, the fuel actuator module 124, the phaser actuator module 158, the boost actuator module 164, and the EGR actuator module 172. For these engine actuators, the actuator values may correspond to a cylinder activation/deactivation sequence, fueling rate, intake and exhaust cam phaser angles, boost pressure, and EGR valve opening area, respectively. The ECM 114 may control the actuator values in order to cause the engine 102 to generate a desired engine output torque.

Figure 2:
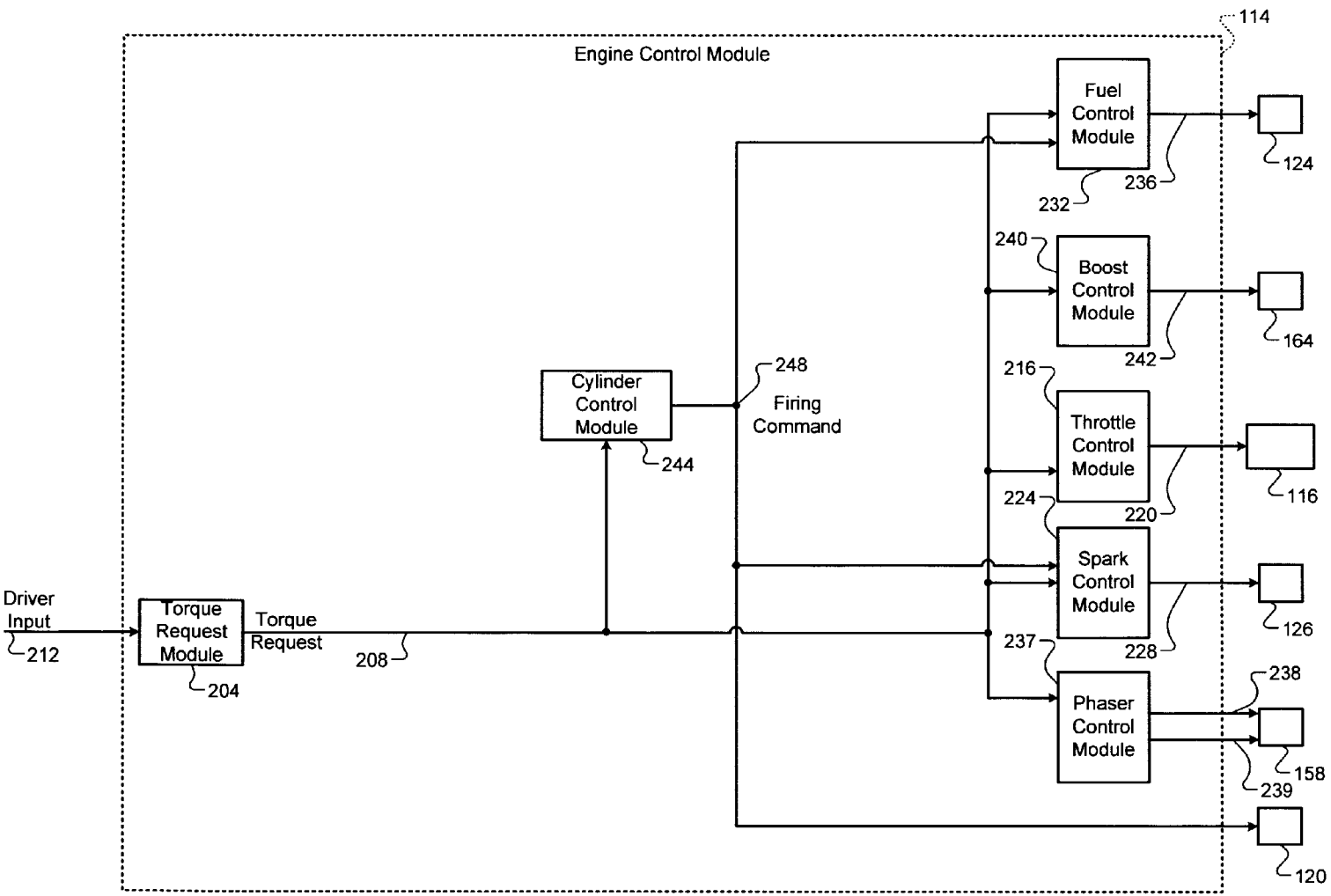
FIG. 2 is a functional block diagram of an example engine control system according to the present disclosure.

Referring now to FIG. 2, a functional block diagram of an example engine control system is presented. A torque request module 204 may determine a torque request 208 based on one or more driver inputs 212, such as an accelerator pedal position, a brake pedal position, a cruise control input, and/or one or more other suitable driver inputs. The torque request module 204 may determine the torque request 208 additionally or alternatively based on one or more other torque requests, such as torque requests generated by the ECM 114 and/or torque requests received from other modules of the vehicle, such as the transmission control module 194, the hybrid control module 196, a chassis control module, etc.

One or more engine actuators may be controlled based on the torque request 208 and/or one or more other parameters. For example, a throttle control module 216 may determine a target throttle opening 220 based on the torque request 208. The throttle actuator module 116 may adjust opening of the throttle valve 112 based on the target throttle opening 220.

A spark control module 224 may determine a target spark timing 228 based on the torque request 208. The spark actuator module 126 may generate spark based on the target spark timing 228. A fuel control module 232 may determine one or more target fueling parameters 236 based on the torque request 208. For example, the target fueling parameters 236 may include fuel injection amount, number of fuel injections for injecting the amount, and timing for each of the injections. The fuel actuator module 124 may inject fuel based on the target fueling parameters 236.

A phaser control module 237 may determine target intake and exhaust cam phaser angles 238 and 239 based on the torque request 208. The phaser actuator module 158 may regulate the intake and exhaust cam phasers 148 and 150 based on the target intake and exhaust cam phaser angles 238 and 239, respectively. A boost control module 240 may determine a target boost 242 based on the torque request 208. The boost actuator module 164 may control boost output by the boost device(s) based on the target boost 242.

A cylinder control module 244 (see also FIG. 3) generates a firing command 248 for a next cylinder in a predetermined firing order of the cylinders ("the next cylinder"). The firing command 248 indicates whether the next cylinder should be activated or deactivated. For example only, the cylinder control module 244 may set the firing command 248 to a first state (e.g., 1) when the next cylinder should be activated and set the firing command 248 to a second state (e.g., 0) when the next cylinder should be deactivated. While the firing command 248 is and will be discussed with respect to the next cylinder in the predetermined firing order, the firing command 248 may be generated for a second cylinder immediately following the next cylinder in the predetermined firing order, a third cylinder immediately following the second cylinder in the predetermined firing order, or another cylinder following the next cylinder in the predetermined firing order.

The cylinder actuator module 120 deactivates the intake and exhaust valves of the next cylinder when the firing command 248 indicates that the next cylinder should be deactivated. The cylinder actuator module 120 allows opening and closing of the intake and exhaust valves of the next cylinder when the firing command 248 indicates that the next cylinder should be activated.

The fuel control module 232 halts fueling of the next cylinder when the firing command 248 indicates that the next cylinder should be deactivated. The fuel control module 232 sets the target fueling parameters 236 to provide fuel to the next cylinder when the firing command 248 indicates that the next cylinder should be activated. The spark control module 224 may provide spark to the next cylinder when the firing command 248 indicates that the next cylinder should be activated. The spark control module 224 may provide or halt spark to the next cylinder when the firing command 248 indicates that the next cylinder should be deactivated. Cylinder deactivation is different than fuel cutoff (e.g., deceleration fuel cutoff) in that the intake and exhaust valves of cylinders to which fueling is halted during fuel cutoff are still opened and closed during fuel cutoff whereas the intake and exhaust valves of cylinders are maintained closed when those cylinders are deactivated.

Figure 3:
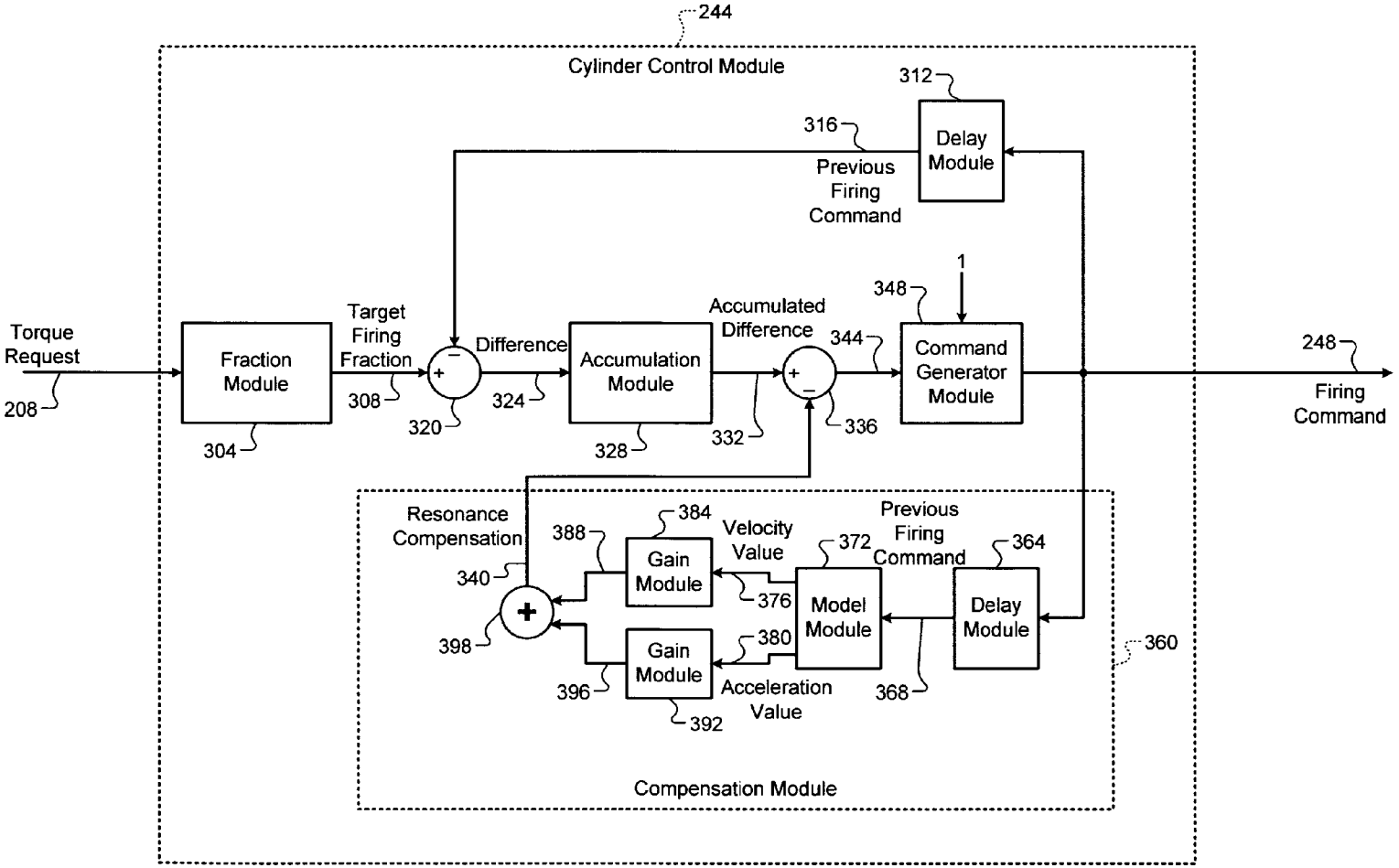
FIG. 3 is a functional block diagram of an example cylinder control module according to the present disclosure.

Referring now to FIG. 3, a functional block diagram of an example implementation of the cylinder control module 244 is presented. A fraction module 304 determines a target firing fraction 308 based on the torque request 208. The target firing fraction 308 may correspond to a portion of the total number of cylinders of the engine 102 that should be activated to achieve the torque request 208. When all of the cylinders of the engine 102 are activated (and zero of the cylinders are deactivated), the engine 102 may be capable of outputting a predetermined maximum torque. The target firing fraction 308 may be a value between 0.0 and 1.0, inclusive, and the fraction module 304 may set the target firing fraction 308 equal to or based on the torque request 208 divided by the predetermined maximum torque.

A first delay module 312 receives the firing command 248, stores the firing command 248 for one cylinder firing event, and outputs a previous (e.g., last) value of the firing command 248 as a previous firing command 316. The previous firing command 316 may correspond to the firing command 248 used for the cylinder immediately before the next cylinder in the predetermined firing order ("the last cylinder"). For example, the previous firing command 316 may be a 1 (the first state) when the last cylinder was activated pursuant to the firing command 248 generated for the last cylinder, and the previous firing command 316 may be a 0 (the second state) when the last cylinder was deactivated pursuant to the firing command 248 generated for the last cylinder. For example only, the first delay module 312 may include a one-unit, first-in-first-out (FIFO) buffer.

A first difference module 320 determines a difference 324 based on the target firing fraction 308 and the previous firing command 316. For example, the first difference module 320 may set the difference 324 equal to or based on the target firing fraction 308 minus the previous firing command 316.

An accumulation module 328 sums the difference 324 with a sum of previous values of the difference 324 to generate an accumulated difference 332. In other words, the accumulation module 328 sums the difference with a previous (e.g., last) value of the accumulated difference 332 to generate the accumulated difference 332. The accumulated difference 332 is input to a second difference module 336.

A resonance compensation value 340 is also input to the second difference module 336. The resonance compensation value 340 is discussed further below. The second difference module 336 adjusts the accumulated difference 332 based on the resonance compensation value 340 to produce an adjusted value. In other words, the second difference module 336 determines the adjusted value 344 based on the accumulated difference 332 and the resonance compensation value 340. For example, the second difference module 336 may set the adjusted value 344 equal to or based on the accumulated difference 332 minus the resonance compensation value 340.

A command generator module 348 generates the firing command 248 for the next cylinder based on the adjusted value 344 and a predetermined value. More specifically, the command generator module 348 may generate the firing command 248 for the next cylinder based on a comparison of the adjusted value 344 and the predetermined value. For example only, the command generator module 348 may set the firing command 248 for the next cylinder to 1 (to command that the next cylinder be activated) when the adjusted value 344 is greater than or equal to the predetermined value. When the adjusted value 344 is less than the predetermined value, the command generator module 348 may set the firing command 248 for the next cylinder to 0 (to command that the next cylinder be deactivated). In implementations where the firing command 248 is set to 1 to command activation of the next cylinder and to 0 to command deactivation of the next cylinder, the predetermined value may be equal to 1. The first delay module 312, the first difference module 320, the accumulation module 328, the second difference module 336, and the command generator module 348 may collectively form what may be referred to as a sigma-delta discretizer.

A compensation module 360 generates the resonance compensation value 340. A second delay module 364 receives the firing command 248, stores the firing command 248 for one cylinder firing event, and outputs a previous (e.g., last) value of the firing command 248 as a previous firing command 368. The previous firing command 368 may correspond to the firing command 248 used for the last cylinder in the predetermined firing order. For example, the previous firing command 368 may be a 1 (the first state) when the last cylinder was activated pursuant to the firing command 248 generated for the last cylinder, and the previous firing command 368 may be a 0 (the second state) when the last cylinder was deactivated pursuant to the firing command 248 generated for the last cylinder. For example only, the second delay module 364 may include a one-unit, first-in-first-out (FIFO) buffer. In various implementations, the second delay module 364 may be omitted and the previous firing command 316 may be used.

A model module 372 generates velocity and acceleration values 376 and 380 based on the state of a (virtual) model and a response of the model to the previous firing command 368. The state of the model at a given time may be based on responses of the model to previous firing commands. For example only, the model may be or be based on a spring-mass-damper model. Characteristics of the model are determined based on characteristics of the powertrain of the vehicle and a predetermined resonant frequency. The velocity value 376 may correspond to a velocity of the mass (of the model) in response to the previous firing command 368. The acceleration value 380 may correspond to an acceleration of the mass in response to the previous firing command 368.

In various implementations, the model module 372 may selectively update one or more characteristics of the model based on one or more operating parameters. For example, the predetermined resonant frequency may be a multiple or vary with an engine speed. Thus, the model module 372 may selectively update one or more characteristics of the model based on the engine speed. The model module 372 may determine the velocity and acceleration values 376 and 380 at the same rate as the command generator module 348 generates the firing command 248. For example, in various implementations, the model module 372 may update the velocity and acceleration values 376 and 380 and the command generator module 348 may update the firing command 248 once per cylinder event (e.g., every predetermined amount of crankshaft rotation). In other implementations, the model module 372 may update the velocity and acceleration values 376 and 380 at a time-based rate, such as once per predetermined period where the predetermined period is set to be shorter than a minimum possible period between two cylinder events.

A first gain module 384 multiplies the velocity value 376 by a first predetermined gain to produce a first resonance value 388. A second gain module 392 multiplies the acceleration value 380 by a second predetermined gain to produce a second resonance value 396. The first and second predetermined gains may be calibratable and may be set based on how aggressively the accumulated difference 332 should be adjusted to avoid (discourage) operation at the predetermined resonant frequency and to encourage operation outside of the predetermined resonant frequency.

A summer module 398 sets the resonance compensation value 340 equal to or based on a sum of the first and second resonance values 388 and 396. The effect of the use of the resonance compensation value 340 is to encourage activation of the next cylinder when activation of the next cylinder would not add energy to the system and to decrease the likelihood of operation at the predetermined resonant frequency. Conversely, the resonance compensation value 340 discourages activation of the next cylinder when activation of the next cylinder would add energy to the system and similarly decreases the likelihood of operation at the predetermined resonant frequency. The resonance compensation value 340 provides a notch (or band stop) filter like effect on the generation of the firing command 248 to avoid operation at the predetermined resonance frequency.

Figure 4B:
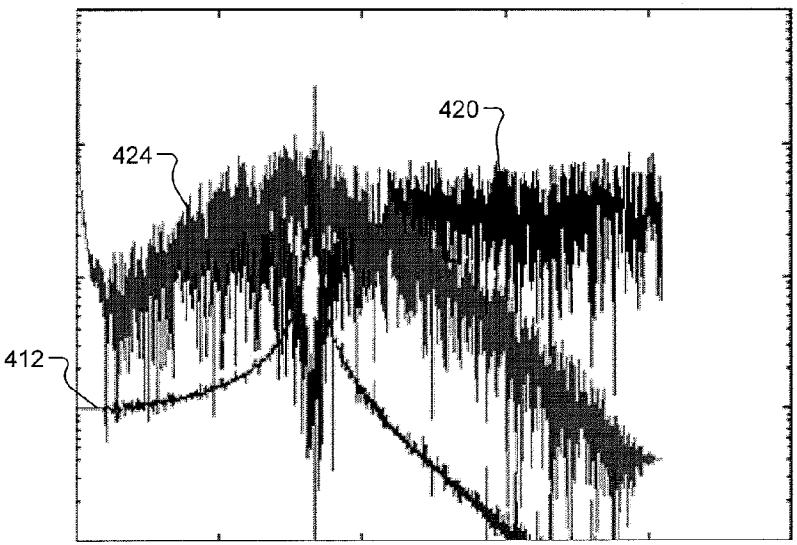
FIGS. 4A and 4B are graphs of Fast Fourier Transforms (FFTs) of cylinder firing patterns.
Figure 4A:
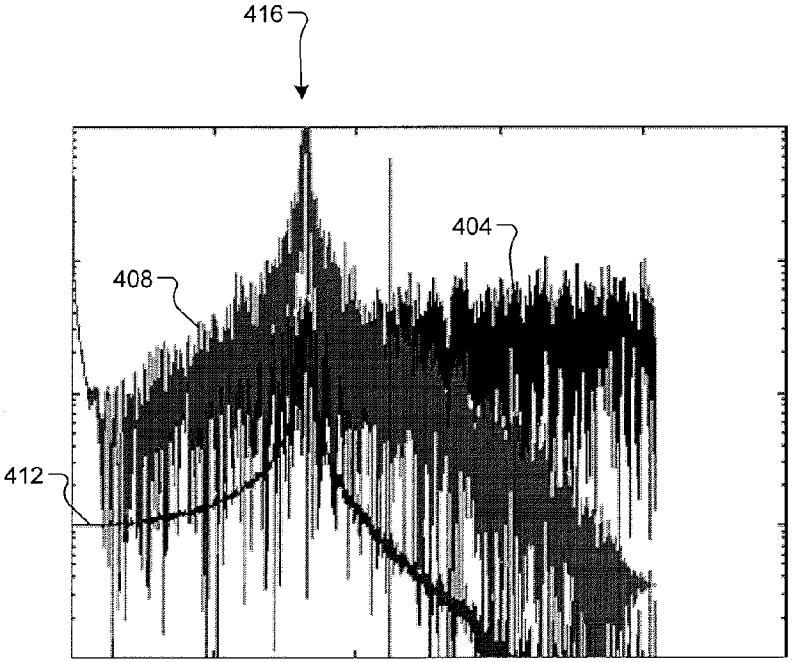

An example of effectiveness of the use of the resonance compensation value 340 for a predetermined resonant frequency can be seen by comparing FIGS. 4A and 4B. FIG. 4A includes a graph for an implementation where the compensation module 360 and the second difference module 336 are omitted and the accumulated difference 332 is used as the adjusted value 344. Trace 404 tracks a first Fast Fourier Transform (FFT) of the adjusted value 344, and trace 408 tracks a second FFT of the firing command 248. Trace 412 tracks a transfer function of the plant at question. As illustrated by 416, the second FFT includes a peak near the peak in the transfer function.

FIG. 4B includes a graph for an implementation similar to that of FIG. 3 where the compensation module 360 and the second difference module 336 are included. Trace 420 tracks an FFT of the adjusted value 344, and trace 424 tracks an FFT of the firing command 248. As illustrated in FIG. 4B, the adjustment of the adjusted value 344 based on the resonance compensation value 340 adjusts the firing command 248 to attenuate the peak.

Referring back to FIG. 3, in various implementations, more than one predetermined resonant frequency may targeted for avoidance. In such implementations, the characteristics of the model may be calibrated based on characteristics of the powertrain and the two or more predetermined resonant frequencies.

Figure 5:
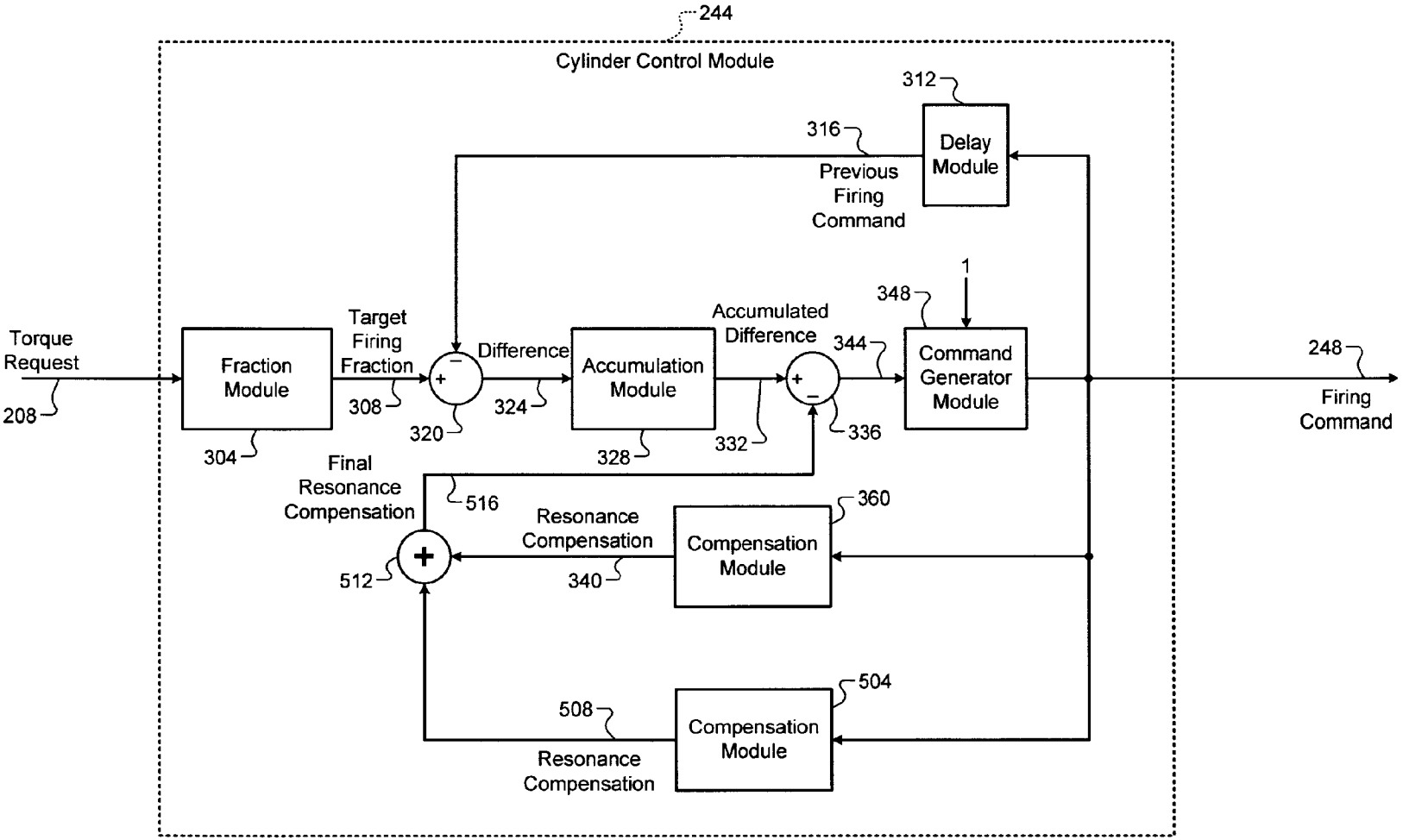
FIG. 5 is a functional block diagram of an example cylinder control module according to the present disclosure.

Additionally or alternatively, as in the example of FIG. 5, multiple compensation modules like the compensation module 360 may be implemented. FIG. 5 includes a functional block diagram of another example implementation of the cylinder control module 244. Referring now to FIG. 5, characteristics of the model of the compensation module 360 are calibrated based on characteristics of the powertrain of the vehicle and a first predetermined resonant frequency.

A second compensation module 504 generates a second resonance compensation value 508. The second compensation module 504 may be similar or identical to the compensation module 360 except that the model of the second compensation module 504 and the first and second predetermined gain values used by the second compensation module 504 may be calibrated based on a second predetermined resonant frequency.

A summer module 512 sets a final resonance compensation value 516 equal to or based on a sum of the resonance compensation value 340 and the second resonance compensation value 508. The second difference module 336 sets the adjusted value 344 based on or equal to the accumulated difference 332 minus the final resonance compensation value 516. While an example with two compensation modules is provided, more than two compensation modules may be implemented, and the summer module 512 may set the final resonance compensation value 516 equal to or based on a sum of the resonance compensation values produced by each of the compensation modules.

Figure 6:
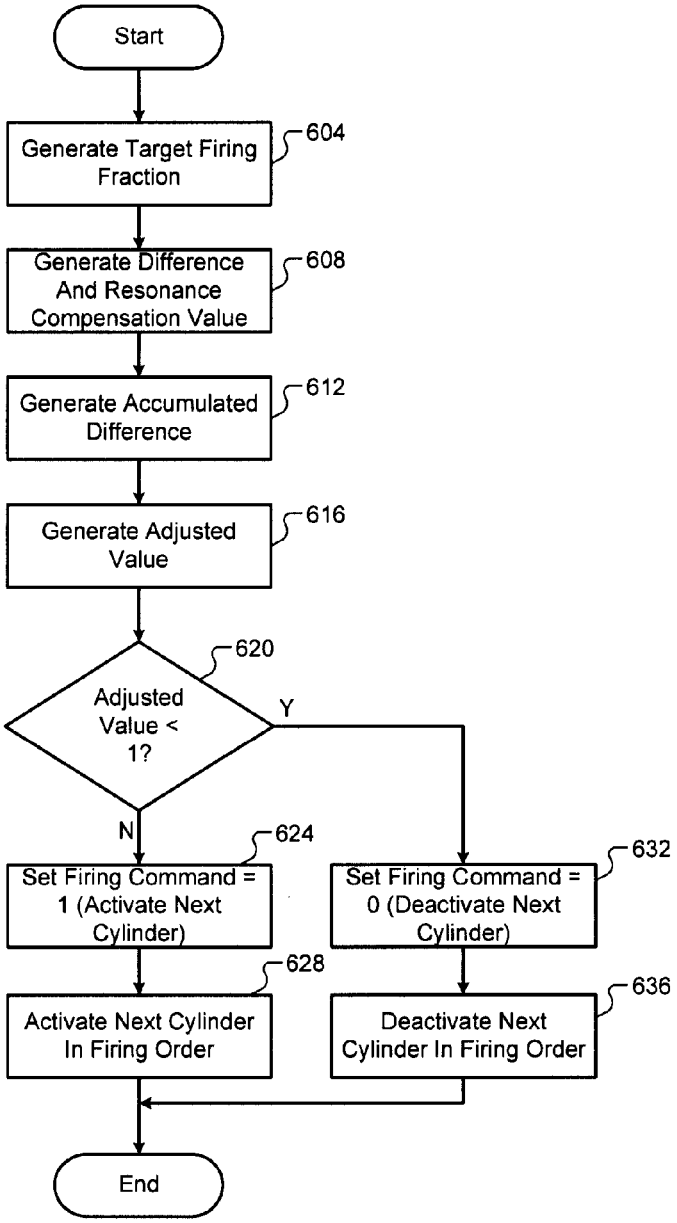
FIG. 6 is a flowchart depicting an example method of controlling cylinder activation and deactivation according to the present disclosure.

Referring now to FIG. 6, a flowchart depicting an example method of controlling cylinder activation and deactivation is presented. Control begins with 604 where the fraction module 304 generates the target firing fraction 308. For example only, the fraction module 304 may set the target firing fraction 308 equal to or based on the torque request 208 divided by the predetermined maximum torque.

At 608, the first difference module 320 generates the difference 324, and the compensation module 360 generates the resonance compensation value 340. The first difference module 320 may set the difference 324 equal to or based on a difference between the target firing fraction 308 and the previous firing command 316. The compensation module 360 generates the resonance compensation value 340 based on the previous firing command 368. More specifically, the model module 372 generates the velocity and acceleration values 376 and 380, the first gain module 384 generates the first resonance value 388 based on the velocity value 376 and the first predetermined gain, and the second gain module 392 generates the second resonance value 396 based on the acceleration value 380 and the second predetermined gain. The summer module 398 sets the resonance compensation value 340 equal to or based on the sum of the first and second resonance values 388 and 396.

The accumulation module 328 generates the accumulated difference 332 based on the difference 324 at 612. The accumulation module 328 may set the accumulated difference 332 equal to or based on the sum of the difference 324 and the previous value of the accumulated difference 332. At 616, the second difference module 336 generates the adjusted value 344. The second difference module 336 may set the adjusted value 344 equal to or based on the accumulated difference 332 minus the resonance compensation value 340.

At 620, the command generator module 348 determines whether the adjusted value 344 is less than 1 (the predetermined value). If 620 is false, the command generator module 348 may set the firing command 248 for the next cylinder in the predetermined firing order to 1 (the first state) at 624 to command activation of the next cylinder. The next cylinder is activated at 628, and control ends. The cylinder actuator module 120 allows opening and closing of the intake and exhaust valves of the next cylinder when the firing command 248 indicates that the next cylinder should be activated. The fuel control module 232 sets the target fueling parameters 236 to provide fuel to the next cylinder when the firing command 248 indicates that the next cylinder should be activated. The spark control module 224 may provide spark to the next cylinder when the firing command 248 indicates that the next cylinder should be activated.

If 620 is true (when the adjusted value 344 is not less than 1), the command generator module 348 may set the firing command 248 for the next cylinder in the predetermined firing order to 0 (the second state) at 632 to command deactivation of the next cylinder. At 636, the next cylinder is deactivated, and control ends. The cylinder actuator module 120 deactivates the intake and exhaust valves of the next cylinder when the firing command 248 indicates that the next cylinder should be deactivated. The fuel control module 232 halts fueling of the next cylinder when the firing command 248 indicates that the next cylinder should be deactivated. The spark control module 224 may provide or halt spark to the next cylinder when the firing command 248 indicates that the next cylinder should be deactivated. While control is shown and discussed as ending, FIG. 6 is illustrative of one control loop, and a control loop may be executed, for example, every predetermined amount of crankshaft rotation.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term module may refer to, be part of, or include an Application Specific Integrated Circuit (ASIC); a discrete circuit; an integrated circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be partially or fully implemented by one or more computer programs executed by one or more processors. The computer programs include processor-executable instructions that are stored on at least one non-transitory tangible computer readable medium. The computer programs may also include and/or rely on stored data. Non-limiting examples of the non-transitory tangible computer readable medium include nonvolatile memory, volatile memory, magnetic storage, and optical storage.

What is claimed is:

1. A cylinder control system of a vehicle, comprising:

a command generator module that generates a first command value and that one of activates and deactivates intake and exhaust valves of a first cylinder of an engine based on the first command value;

a compensation module that generates a compensation value for a second cylinder of the engine based on a response of a model to the first command value;

a fraction module that determines a target value based on a torque request, the target value corresponding to a fraction of a total number of cylinders of the engine to be activated;

an accumulation module that generates an accumulated difference based on a previous value of the accumulated difference and a difference between the target value and the first command value; and a difference module that generates an adjusted value based on a second difference between the accumulated difference and the compensation value, wherein the command generator module further:

generates a second command value based on the adjusted value; and one of activates and deactivates intake and exhaust valves of the second cylinder based on the second command value.

2. The cylinder control system of claim 1 wherein at least one characteristic of the model is configured based on a predetermined resonant frequency of the vehicle.

3. The cylinder control system of claim 1 wherein the compensation module determines a velocity value and an acceleration value based on the response of the model to the first command value and generates the compensation value based on the velocity and acceleration values.

4. The cylinder control system of claim 3 wherein the compensation module determines a first resonance value based on a product of the velocity value and a first predetermined gain, determines a second resonance value based on a product of the acceleration value and a second predetermined gain, and determines the compensation value based on the first and second resonance values.

5. The cylinder control system of claim 4 wherein the compensation module determines the compensation value based on a sum of the first and second resonance values.

6. The cylinder control system of claim 1 wherein the difference module determines the adjusted value based on the accumulated difference minus the compensation value.

7. The cylinder control system of claim 1 wherein the command generator module generates the second command value based on a comparison of the adjusted value with a predetermined value.

8. The cylinder control system of claim 1 wherein the command generator module:

sets the second command value to a first value when the adjusted value is less than a predetermined value and sets the second command value to a second value when the adjusted value is not less than the predetermined value;

deactivates the intake and exhaust valves of the second cylinder when the second command value is set to the first value; and activates the intake and exhaust valves of the second cylinder when the second command value is set to the second value.

9. The cylinder control system of claim 1 wherein the fraction module determines the target value further based on a predetermined maximum torque of the engine.

10. A cylinder control method for a vehicle, comprising:

generating a first command value;

one of activating and deactivating intake and exhaust valves of a first cylinder of an engine based on the first command value;

generating a compensation value for a second cylinder of the engine based on a response of a model to the first command value;

determining a target value based on a torque request, the target value corresponding to a fraction of a total number of cylinders of the engine to be activated;

generating an accumulated difference based on a previous value of the accumulated difference and a difference between the target value and the first command value;

generating an adjusted value based on a second difference between the accumulated difference and the compensation value;

generating a second command value based on the adjusted value; and one of activating and deactivating intake and exhaust valves of the second cylinder based on the second command value.

11. The cylinder control method of claim 10 wherein at least one characteristic of the model is configured based on a predetermined resonant frequency of the vehicle.

12. The cylinder control method of claim 10 further comprising:

determining a velocity value and an acceleration value based on the response of the model to the first command value; and generating the compensation value based on the velocity and acceleration values.

13. The cylinder control method of claim 12 further comprising:

determining a first resonance value based on a product of the velocity value and a first predetermined gain;

determining a second resonance value based on a product of the acceleration value and a second predetermined gain; and determining the compensation value based on the first and second resonance values.

14. The cylinder control method of claim 13 further comprising determining the compensation value based on a sum of the first and second resonance values.

15. The cylinder control method of claim 10 further comprising determining the adjusted value based on the accumulated difference minus the compensation value.

16. The cylinder control method of claim 10 further comprising generating the second command value based on a comparison of the adjusted value with a predetermined value.

17. The cylinder control method of claim 10 further comprising:

setting the second command value to a first value when the adjusted value is less than a predetermined value and sets the second command value to a second value when the adjusted value is not less than the predetermined value;

deactivating the intake and exhaust valves of the second cylinder when the second command value is set to the first value; and activating the intake and exhaust valves of the second cylinder when the second command value is set to the second value.

18. The cylinder control method of claim 10 further comprising determining the target value further based on a predetermined maximum torque of the engine.

19. A cylinder control system of a vehicle, comprising:

a command generator module that generates a first command value and that one of activates and deactivates intake and exhaust valves of a first cylinder of an engine based on the first command value;

a compensation module that determines a velocity value and an acceleration value based on a response of a model to the first command value, that determines a first resonance value based on a product of the velocity value and a first predetermined gain, that determines a second resonance value based on a product of the acceleration value and a second predetermined gain, and that generates a compensation value for a second cylinder of the engine based on the first and second resonance values;

a fraction module that determines a target value based on a torque request, the target value corresponding to a fraction of a total number of cylinders of the engine to be activated, wherein the command generator module further:

generates a second command value based on the compensation value and a difference between the target value and the first command value; and one of activates and deactivates intake and exhaust valves of the second cylinder based on the second command value.

20. A cylinder control method for a vehicle, comprising:

generating a first command value;

one of activating and deactivating intake and exhaust valves of a first cylinder of an engine based on the first command value;

determining a velocity value and an acceleration value based on a response of a model to the first command value;

determining a first resonance value based on a product of the velocity value and a first predetermined gain;

determining a second resonance value based on a product of the acceleration value and a second predetermined gain;

generating a compensation value for a second cylinder of the engine based on the first and second resonance values;

determining a target value based on a torque request, the target value corresponding to a fraction of a total number of cylinders of the engine to be activated;

generating a second command value based on the compensation value and a difference between the target value and the first command value; and one of activating and deactivating intake and exhaust valves of the second cylinder based on the second command value.

* * * * *